US006853238B1

(12) United States Patent
Dempsey et al.

(10) Patent No.: US 6,853,238 B1
(45) Date of Patent: Feb. 8, 2005

(54) BANDGAP REFERENCE SOURCE

(75) Inventors: Dennis A. Dempsey, Limerick (IE); Stefan Marinca, Limerick (IE)

(73) Assignee: Analog Devices, Inc., Norwood, MA (US)

( * ) Notice: Subject to any disclaimer, the term of this patent is extended or adjusted under 35 U.S.C. 154(b) by 0 days.

(21) Appl. No.: 10/278,267

(22) Filed: Oct. 23, 2002

(51) Int. Cl.[7] ..... G05F 1/10

(52) U.S. Cl. ..... 327/539; 327/541; 327/542; 323/315

(58) Field of Search ..... 327/540, 539, 327/541, 543, 542; 323/315

(56) References Cited

U.S. PATENT DOCUMENTS 4,263,519 A * 4/1981 Schade, Jr. ..... 327/539
5,528,128 A * 6/1996 Melse ..... 323/313
5,629,611 A * 5/1997 McIntyre ..... 323/313
5,867,013 A * 2/1999 Yu ..... 323/314
5,900,773 A * 5/1999 Susak ..... 327/539
5,936,392 A * 8/1999 Taylor ..... 323/315
6,091,285 A * 7/2000 Fujiwara ..... 327/539
6,433,621 B1 * 8/2002 Smith et al. ..... 327/538
6,501,299 B2 * 12/2002 Kim et al. ..... 326/83
6,507,179 B1 * 1/2003 Jun et al. ..... 323/313
2002/0158682 A1 * 10/2002 Conte et al. ..... 327/539

OTHER PUBLICATIONS

Brokaw, A. Paul, "A Simple Three–Terminal IC Bandgap Reference", IEEE Journal of Solid–State Circuits, vol. SC–9, No. 6, Dec. 1974, pp. 388–393 [best copy].
Widlar, Robert J., "New Developments in IC voltage Regulators", IEEE Journal of Solid–State Circuits, vol.SC–6, No. 1, Feb. 1971, pp. 2–7 [best copy].
Johns, David A,. and Martin, Ken, "Analog Integrated Circuit Design", Chapters 8.5 & 8.6, John Wiley & Sons, 1997, pp. 353–362.

* cited by examiner

*Primary Examiner*—Terry D. Cunningham
(74) *Attorney, Agent, or Firm*—Wolf, Greenfield & Sacks, P.C.

(57) ABSTRACT

The invention describes a bandgap reference circuit that may be configured to provide a reference current or voltage as an output thereof. The output may be provided in the form of a constant source, or one including PTAT or CTAT dependencies. The circuit utilises a single amplifier whose output is coupled to a current control block which is then used to drive a dual feedback loop of the amplifier. Inputs to the amplifier are directly coupled to reference nodes in a manner which establishes a PTAT voltage across a resistor at an input of the amplifier.

18 Claims, 6 Drawing Sheets

BANDGAP REFERENCE SOURCE

FIELD OF THE INVENTION

This invention relates to voltage and current reference sources. In particular, the invention relates to voltage and current reference sources adapted to provide a low power supply with low power consumption at a low implementation cost.

BACKGROUND TO THE INVENTION

Bandgap voltage reference circuits are well known in the art from the early 1970's as is evidenced by the IEEE publications of Robert Widlar ( IEEE Journal of Solid State Circuits Vol. SC-6 No 1 February 1971) and A. Paul Brokaw (IEEE Journal of Solid State Circuits Vol. SC-9 No 6 December 1974).

These circuits implement configurations for the realization of a stabilized bandgap voltage. As discussed in David A. Johns and Ken Martin "Analog Integrated Circuit Design", John Wiley. & Sons, 1997, incorporated herein by way of reference, these circuits and other modifications to same are based on combining the voltage of a forward based diode (or base emitter junction) having a negative temperature coefficient from a voltage proportional to absolute temperature (PTAT). Typically, the PTAT voltage is formed by amplifying the voltage difference (ΔVbe) of two forward biased junctions operating at different current densities.

The formation of a voltage reference circuit is typically provided by the addition of this PTAT voltage which increases with absolute temperature to a voltage that substantially decreases with absolute temperature, i.e. a CTAT (complementary to absolute temperature) voltage. Similarly, a substantially constant reference current source is typically generated by the addition of a PTAT and CTAT current. The PTAT and CTAT currents may be generated by mirroring PTAT and CTAT voltages across resistors. The reference current or voltage source may provide a constant current or voltage over a temperature range of interest, or a current or voltage with a fixed chosen temperature dependency.

FIG. 1 shows an exemplary circuit diagram for generating a current reference source according to the prior art. It consists of two operational amplifiers, A1 and A2, two diode connected transistors Q1 and Q2, three resistors, R1, R2 and R3 and six PMOS transistors, M1, M2, M3, M4, M5 and M6. The sources of M1, M2, M3, M4, M5 and M6 are connected to VDD. The inverting input of the operational amplifier A1 is connected to the inverting input of the operational amplifier A2, the emitter of the transistor Q1 and to the drain of the PMOS M1. The non-inverting input of the operational amplifier A1 is connected to emitter of transistor Q2 via a resistor R1 and to the drain of the PMOS M3. The output of the operational amplifier A1 is connected to the gate and drain of M2 and the gates of M1, M3 and M5. The non-inverting input of the operational amplifier A2 is connected via a resistor R2 to ground and to the drain of M4. The output of the operational amplifier A2 is connected to the gates of M4 and M6. The drain of M6 is connected to the drain of M5. The drain of M6 is also connected to ground via a resistor R3. It will be appreciated from the circuit of FIG. 1 that the operation of the op-amp A1 is such as to keep the voltage at its terminals, points "a" and "b", substantially at the same voltage level. This forces currents into the emitter of Q1 and Q2 flowing from the PMOS mirror devices M1 and M3.

Q2 is chosen to have an emitter area "n" times larger than Q1, and as such the two diodes are operating at different current densities and a PTAT voltage, ΔVbe, is generated across resistor R1. This is equal to the base-emitter voltage difference between Q1 and Q2. As the voltage across R1 is a PTAT voltage, the current flowing through R1, M1, M2, M3 and M5 is a PTAT current. However the voltage at node "a" and therefore the voltage of the inverting terminal of A2 is a CTAT voltage, as it is the base-emitter voltage of transistor Q1. As both terminals of the operational amplifier A2 are forced to be at the same voltage level, the voltage of the non-inverting input of A2 is also a CTAT voltage and is produced across R2. Therefore, the drain current of M4 is a CTAT current, which in turn results in the drain current of M6 being a CTAT current As the current flowing through R3 is the sum of the currents flowing through the drains of M5 and M6, it will be appreciated that the resulting reference current flowing through R3 will be a combination of PTAT and CTAT currents, while the reference voltage across R3 will be a combination of PTAT and CTAT voltages. The reference levels shown are typically ground potentials.

One of the problems associated with this prior art circuit is that it requires two amplifiers and multiple current mirrors to generate the PTAT and CTAT currents which are required for operation of the circuit in the necessary fashion.

An alternative implementation of a current and voltage reference source that attempts to overcome this problem is shown in FIG. 2, which requires only one amplifier for operation. The same reference numerals are used for the same components. It will be appreciated that this circuit is similar in operation to the circuit of FIG. 1. However, the circuit differs in that the connection between the inverting input of the operational amplifier A1 and the operational amplifier A2 in FIG. 1 is replaced with a direct connection between the inverting terminal of A1 to ground via a resistor R2*a*. The connection between the output of A1 and M2 and M5 of FIG. 1 is also no longer present in FIG. 2.

Additionally, the non-inverting terminal of operational amplifier A1 is connected in FIG. 2 to ground via a resistor R2*b*. If the resistors R2*a* and R2*b* were not included, the PTAT current through M1, M3 and M6 would be identical to that of FIG. 1. However, by including R2*a* and R2*b*, the voltage drop over R2*a* and R2*b* is the same CTAT voltage. Therefore, it will be appreciated that the drain current of M1, M3 and M6 will now be a combination of PTAT and CTAT currents. This, it will be appreciated, also produces a reference voltage and current source as required.

However, the embodiment of FIG. 2, while an improvement over FIG. 1, suffers in that a relatively large area of silicon is required to implement the circuit and/or there is a high level of power consumption, due to the two resistors having direct paths from the amplifier inputs to the ground. In common embodiments of the prior art, higher value resistors are used to save power. However this in turn results in a larger area, which therefore increases the manufacturing costs. It will be appreciated therefore that in the embodiments of the prior art designs area is conventionally traded off against power consumption.

There is therefore a need to provide an improved reference current and reference voltage generating circuit.

SUMMARY OF THE INVENTION

Accordingly, the present invention provides a bandgap voltage reference and current source which is adapted to overcome these and other needs of the prior art. In accordance with a first embodiment of the invention a bandgap reference circuit is provided, the reference circuit providing a reference node at an output thereof, the circuit comprising an amplifier having first and second inputs and an output, the output being coupled to an input of a current control block, the current control block having first and second outputs, a first output being coupled to the output reference node and the second output being coupled to a dual feedback loop of the amplifier, thereby coupling the output of the amplifier to the first and second inputs of the amplifier, the first and second inputs being additionally coupled to a first and second reference node, one of the input nodes being coupled directly to its respective reference node via an active element and the second input node being coupled via an impedance element in series with a second active element.

The first and second reference nodes are desirably at the same potential, and typically at a ground potential.

The active elements are desirably transistors and are typically selected from either bipolar transistors or MOSFET transistors configurations and can be provided in an NPN or PNP implementation.

By coupling the first and second input nodes directly to their respective reference nodes via active elements or components, the circuit of the present invention reduces the number of components required for implementation of a reference circuit.

The output reference node may be configured to provide a voltage or current reference. This reference may be provided in either a constant form, or one which is CTAT or PTAT dependent.

The input to the current control block may be provided as a voltage signal input or a current signal input.

In further embodiments the amplifier may further comprise a second output node, a first output node being coupled via a first current mirror to a feedback loop of the amplifier and the second output node being coupled via a second current mirror to the circuit reference output node.

At least one of the feedback paths is desirably coupled via a load to a third reference node. The load is typically configured to provide a CTAT current or a PTAT current. A typical implementation to provide a CTAT current is provided by a transistor component provided in a transistor follower configuration, the source of the transistor being coupled via an impedance element to ground.

The current control block may comprise circuitry defining a current mirror therein.

The current mirror may be provided by a first, second and third transistor, the sources of each transistor being coupled to a supply potential, the gates of the first, second and third transistor being coupled to one another and the second transistor being provided in a transistor follower configuration, the output of the amplifier being provided to the coupled gates of the first, second and third transistors, the drain of the first transistor providing the second output of the current mirror and the drain of the third transistor providing the first output of the mirror.

In an alternative embodiment, the current mirror includes a first and second transistor, the sources of each transistor being coupled to a supply potential, the drain of the first transistor providing a first output of the mirror, the drain of the second transistor providing the second output and the gates of the two transistors being coupled to one another, with the output of the amplifier being coupled to the gates of the first and the second transistors.

In yet a further embodiment of the present invention a current control block is provided which incorporates a controllable impedence, the control block providing for a controllable output.

These and other features and advantages of the present invention will be better understood with reference to the following drawings.

DETAILED DESCRIPTION OF THE DRAWINGS

Figure 1:
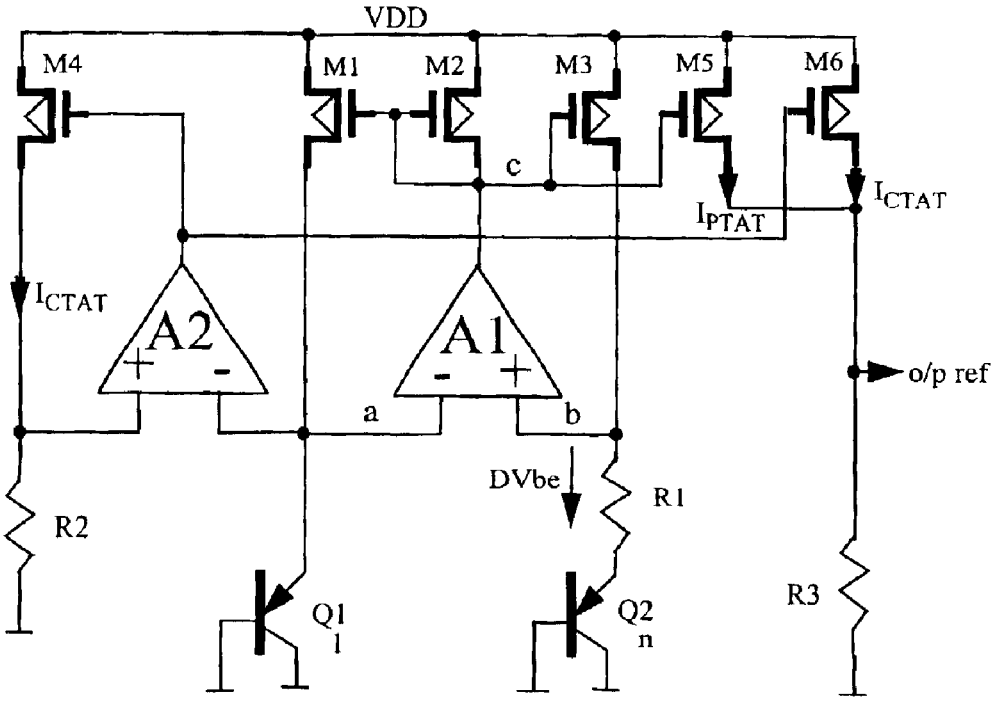
Fig.1 (PRIOR ART)
FIG. 1 is a schematic diagram of a reference current and reference voltage generating circuit according to the prior art.
Figure 2:
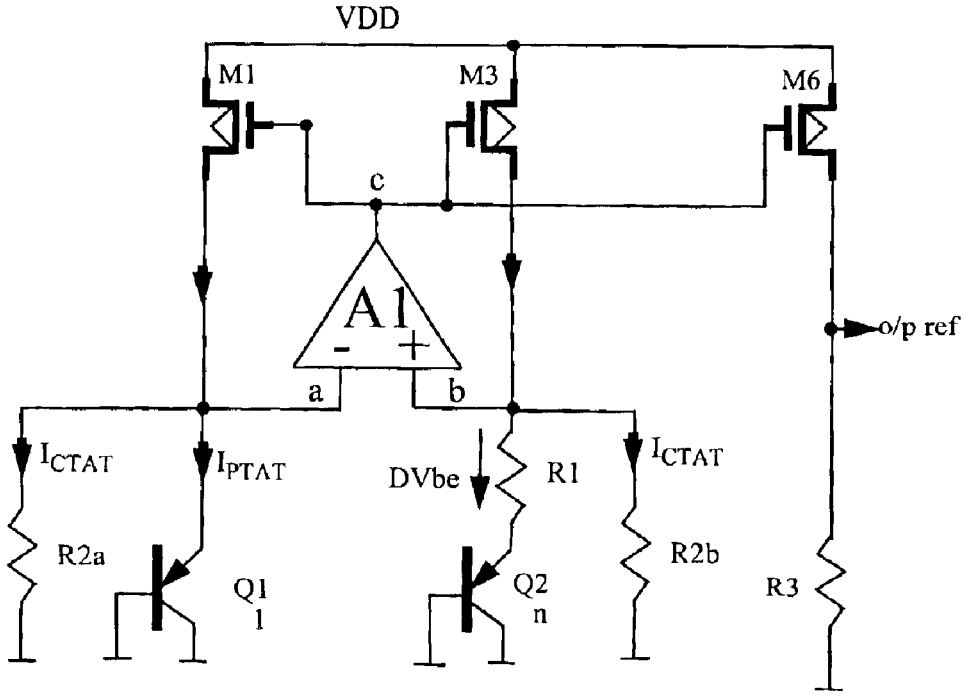
Fig.2 (PRIOR ART)
FIG. 2 is an alternative schematic diagram of a reference current and reference voltage generating circuit in accordance with the prior art.

FIGS. 1 and 2 have been described with reference to the prior art in the background to the invention section above.

Figure 3:
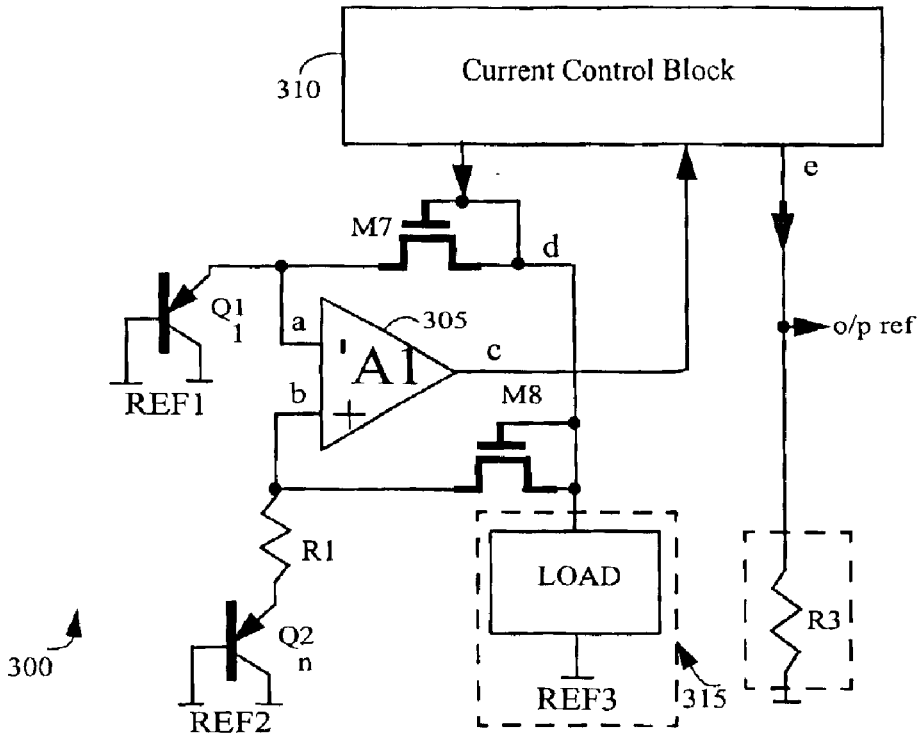
FIG. 3 is a schematic diagram in block format illustrating a reference circuit according to the present invention.

FIG. 3 shows in block diagram format a bandgap reference circuit 300 according to the present invention. The circuit provides a reference node (o/p ref.) at an output of the circuit and includes an amplifier 305 having first (node a) and second (node b) inputs and an output (node c). The output is coupled to an input of a current control block 310, which is provided with first and second outputs. The first output is coupled to the output reference node (o/p ref.) and the second output is coupled to a dual feedback loop of the amplifier, thereby coupling the output of the amplifier to the first and second inputs of the amplifier. A load 315 is optionally provided on one of the feedback loops and is typically used to generate either CTAT or PTAT currents. The first (node a) and second (node b) inputs are additionally coupled to a first (ref1) and second reference (ref2) node respectively. In those embodiments that include the load 315, the load 315 is coupled to a third reference node, ref3. In the embodiment of FIG. 3, node a is coupled directly to its respective reference node (ref1) via a transistor (Q1) and node b is coupled via an impedance element, shown as a resistor (R1) in series with a second transistor (Q2) to its reference node, Ref2.

The output reference may be configured to provide a current or voltage reference by the optional provision of an impedance-shown in the dashed box as resistor R3, so as to convert the current output from the current control block 310 to an equivalent voltage. It is preferable to use the same resistance type for resistors R1 and R3, so as to minimise the effect of manufacturing induced resistor variances. Similarly, in those embodiments that include the load 315, the load resistance should be the same type as that used for R1 and R3.

The dual feedback loop typically includes a first M7 and a second M8 MOSFET transistors on each arm thereof. The transistors are connected in a manner that couples the gates of each transistor to its respective drain and the two transistors together, thereby providing the same potential at node d. In operation, amplifier A1 forces the two inputs "a" and "b" to be at substantially the same voltage level. It also controls the current into Q1, Q2 and R1. As a result, M7 and M8 will operate with substantially the same voltage at the drain, source and gate terminals. If the aspect ratio (W/L) of M7 and M8 arc the same, the emitter currents of Q1 and Q2 will also be the same and will be PTAT currents. In an alternative embodiment the active devices of M7 and M8 are replaced by passive devices, such as resistors, and it will be appreciated that such modifications to the circuit can be made without departing from the spirit or scope of the claimed invention.

Figure 4:
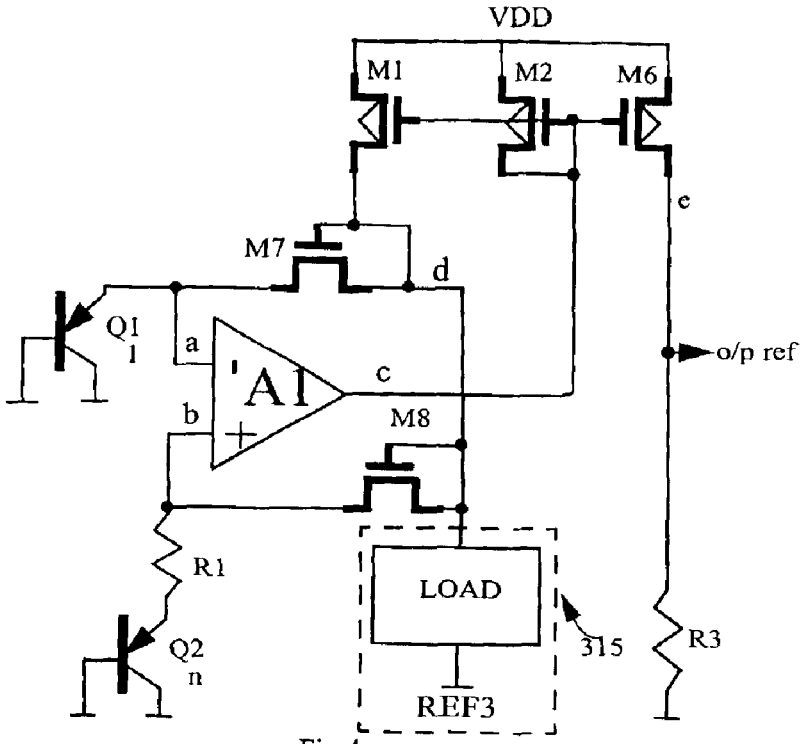
FIG. 4 is a schematic showing a reference current and reference voltage generating circuit according to one embodiment of the present invention.
Figure 5:
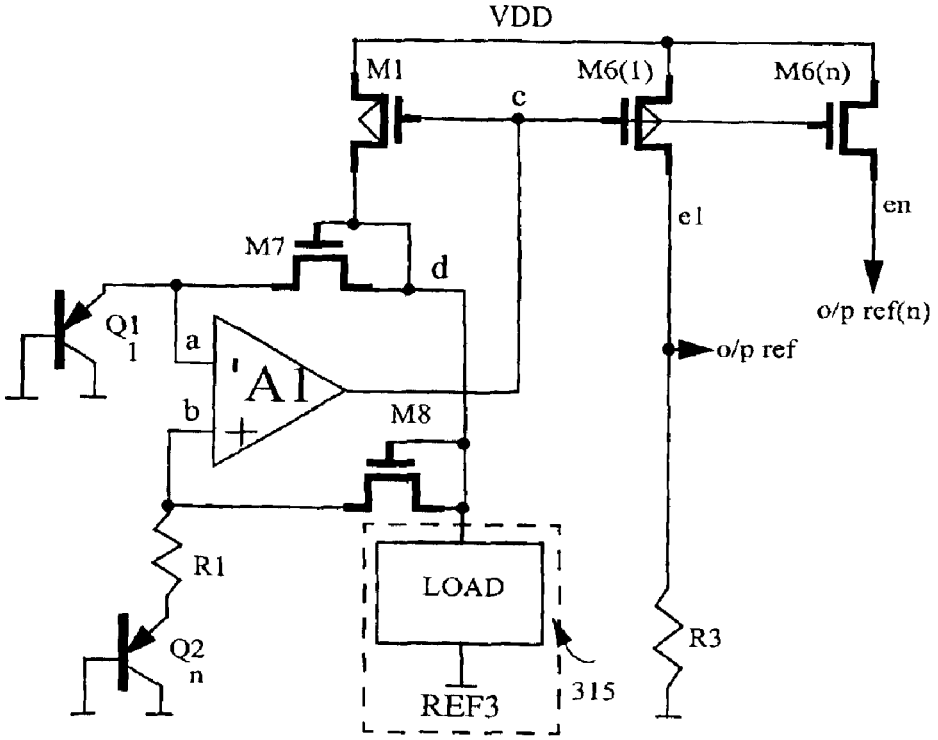
FIG. 5 is a schematic diagram of a reference current and reference voltage generating circuit according to a second embodiment of the present invention.

It is clear from the schematic diagram that the block diagram of FIG. 3 that the circuit of the present invention provides a current control block between an output node, node c, of the amplifier and the dual feedback loop. In preferred embodiments, the current control block will include circuitry defining a current mirror and as will be appreciated by those skilled in the art any suitable current mirror implementation may be used for the operation of the present invention, such as those implementations shown in FIGS. 4 and 5. In particular, it should be appreciated that the current mirror implementations of FIGS. 4 and 5 are representative only of the types of current mirror implementations that could be used and the invention is not restricted to the current mirror implementations described, as any equivalent circuitry provided on the output node of the amplifier may be supplemented for the exemplary embodiments hereinbefore described. The exact current output of the present invention will, as is apparent to those skilled in the art be dependent on the detailed implementation of the respective current mirror. It will be further appreciated from a discussion of FIGS. 8 and 9 that the incorporation of a current mirror into the current control block is not essential for operation of the circuit of the present invention.

In the schematic diagrams of FIG. 3 the potential of lower supply terminals, ref1, ref2, ref3, is not given. However it should be noted that while the base and collector terminals of Q1 and Q2 should share the same potential level, the potential, ref3, to which load 315 is tied does not have to be identical to that of ref1 and ref2. Typically, however, all of these terminals are tied to the same potential, which, in the preferred embodiments of the present invention, is ground. As such it will be appreciated that within the present specification, when a potential is referred to as a reference node or ground potential it is not intended to limit that potential to a specific earth or zero potential but rather any predefined potential relative to VDD. In alternative embodiments to that illustrated in FIG. 3, the position of impedance element (resistor) R1 and active element (transistor) Q2 may be reversed, such that the resistor is tied to ref2. It will be further appreciated that the active elements illustrated as transistors Q1, Q2 may alternatively be provided by diode components.

As will be appreciated a parasitic bipolar device base-emitter diode is available on single well CMOS processes from the source/drain diffusion in the well (emitter) to the well (base) with the substrate (collector) terminal. As shown in FIG. 3, this is typically a PNP device,with N-type wells being preferred for CMOS processes. Further to this, for a substrate PNP on an NWEL CMOS process, coupling the base to the collector potential forms a diode from the emitter terminal to the substrate potential. There may also be small bipolar action in this BJT device, but this can be limited by careful layout embodiment, known to those skilled in the art. Use of such substrate PNP devices is shown in the embodiment of FIG. 3. It will be understood that bipolar transistors are effectively back-to-back diodes and coupling the emitter and collector terminals together combines the characteristics of both the base-emmitter and emmitter-collector diodes into a new, combined diode with BJT device's base as one terminal and the emitter/collector as the second terminal.

Figure 3A:
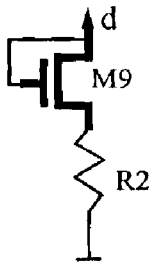
FIG. 3*a* is a detail of a portion of the circuit of FIG. 3, showing a possible configuration for the load component so as to provide a CTAT current.

As detailed above the load 315 may be configured to provide either CTAT or PTAT signals to the feedback loop. FIG. 3*a* shows a detail of one embodiment of the load 315, in this embodiment being configured to provide a CTAT signal. The CTAT signal is provided by the inclusion of a further MOSFET, M9, whose gate is coupled to its drain. It will be appreciated that in this configuration the gate of M8 is also coupled to the gate of the NMOS transistor follower M9, with the source of M9 being coupled to a reference node, ref3, in this embodiment a ground reference, via a resistor R2. The NMOS follower, M9, is used to generate a substantially CTAT current through resistor R2.

Figure 3B:
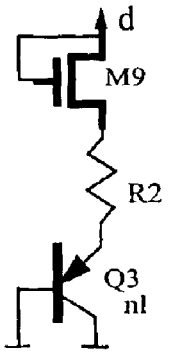
FIG. 3*b* is an alternative detail of a portion of the circuit of FIG. 3, showing a possible configuration for the load component so as to provide a PTAT current.

FIG. 3*b* shows an implementation of the load 315 which can be used to provide a PTAT signal contribution to the feedback loops. In this configuration a MOSFET M9 and resistor R2 combination, such as what was provided in FIG. 3*a*, are used in combination with an additional transistor Q3. This load connection provides curvature correction of the bandgap circuit in cases where the output current flowing through M6 is to be pushed into a resistor in series with a bipolar transistor—as would typically be the case in a bandgap voltage reference. An advantage of the provision of such a PTAT contribution on the feedback loop is that the PTAT contribution is referred to the output of the amplifier, not to the inputs.

FIG. 4 shows in schematic form the circuit of FIG. 3 with detail of one implementation of a current mirror that could be used in accordance with the present invention so as to provide the improved reference current and voltage generating architecture in accordance with the present invention. As in the case of the previous Figures, the same reference numerals are used for similar components which are represented in different figures. The current mirror in this embodiment is provided by the MOSFETs M1, M2 and M6.

It can be seen that portions of the circuit of FIGS. 3 and 4 are similar to the circuits of the prior art as shown in FIGS. 1 and 2. In FIG. 4, the inverting input of the operational amplifier A1 is coupled via a MOSFET M7 to the drain of M1. The gate of M7 is shorted to its drain. However, the resistor R2*a* of FIG. 2 is no longer present in the circuit of FIG. 4, and the connections or couplings from the non-inverting terminal of the operational amplifier A1 also differ from those of FIG. 2. It will also be apparent that the PMOS transistor M3 and resistor R2*b* of FIG. 2 have been removed, and a PMOS transistor M2 has been added in the circuit of FIG. 4.

Transistor M2 is coupled to M6 so as to form a current mirror, with the gates of M2 and M6 coupled together and the gate of M2 coupled both to its drain and to the output of the amplifier A1. The gate of M1 is now coupled to the gate of M2. The non-inverting terminal of A1 is now also coupled to an NMOS transistor M8. The gate and drain of M8 are tied together. If the load 315 was provided by the CTAT current generating circuitry of FIG. 3*a*, the gate of M8 is additionally coupled to the gate and drain of M7 and M9.

It will be appreciated that M1 supplies the currents for Q1, Q2 and R1 via node d. Therefore, the current through M1 and its temperature coefficient will be equal to the sum of the currents flowing through Q1 and Q2 and the current flowing in R2, and will be a combination of PTAT and CTAT currents. Thus, the current flowing in the drain of M6 is a combination of PTAT and CTAT currents.

This combined current provides the reference current source. As in the previous prior art circuits, the current can be replicated through an impedance element, R3, to extract an equivalent reference voltage or a gain scaled version of it, and as such it will be appreciated that the circuitry of the present invention provides a reference source that may be adapted as either a current or voltage reference. In the exemplary circuits of FIGS. 4 and 5, the voltage source is generated by replicating the output current through an impedance element, R3. However, an alternative embodiment may use a potentiometer DAC function as an impedance element, which would also allow digital gain adjustment, as is well known in the art. Similarly, in further modifications to the circuitry illustrated in FIGS. 3 and 4, the functionality of the physical resistors R1 and R2 could be implemented using a potentiometer DAC function instead of the hard coding of components, so as to enable the impedance values to be varied without having to alter the resistive components.

FIG. 5 illustrates a second embodiment of the present invention. It can be seen that the feedback elements of FIG. 5 are the same as those of FIGS. 3 and 4. However the bias current is generated in FIG. 5 through a different control block implementation. PMOS M2 has been removed in this embodiment, and the output of the amplifier A1 is connected instead directly to the gates of M1 and M6. M6 is connected to ground via resistor R3 as before. However the gate of M6 is also connected to the gate of n other PMOS transistors (n being any positive integer number). The drains of each of the "n" PMOS transistors, represented by M6(n) in the diagram of FIG. 5, each provide a reference current Iref(n).

Figure 6:
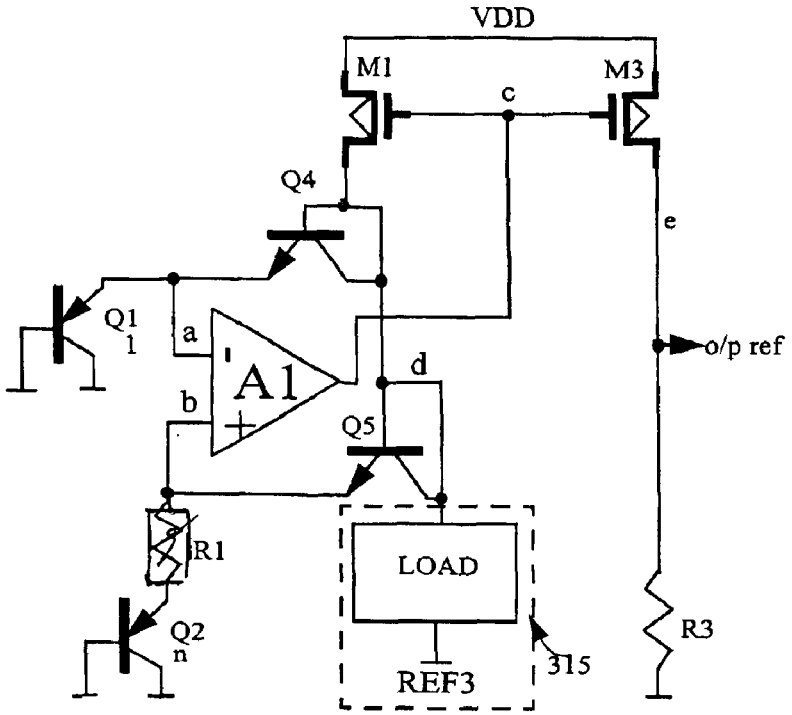
FIG. 6 is a schematic diagram of a reference current and reference voltage generating circuit according to a third embodiment of the present invention.

FIG. 6 differs from the previous embodiments in that the NMOS followers M7 and M8 are replaced by bipolar devices, specifically NPN transistors Q4 and Q5. This embodiment is exemplary of the type of modifications that can be made to configure the circuitry of the present invention for operation in either CMOS or bipolar implementations. For example the configurations of FIG. 3*a* or 3*b* could have the MOSFETS replaced by bipolar elements. The implementation of FIG. 6 also illustrates another current biasing implementation that may be used in the present invention. The output of the operational amplifier A1 is connected only to the gates of two transistors, M1 and M3. The output voltage reference is then taken across the resistor R3 connected to the drain of M3.

It will be appreciated that the values of the components of the circuits described herein to illustrate embodiments of the present invention may be modified to allow a designer to choose the value and temperature coefficient of the desired current. This may be achieved, for example, by scaling the current value and relative current densities of Q1 and Q2 and the current flowing in R2.

Figure 7:
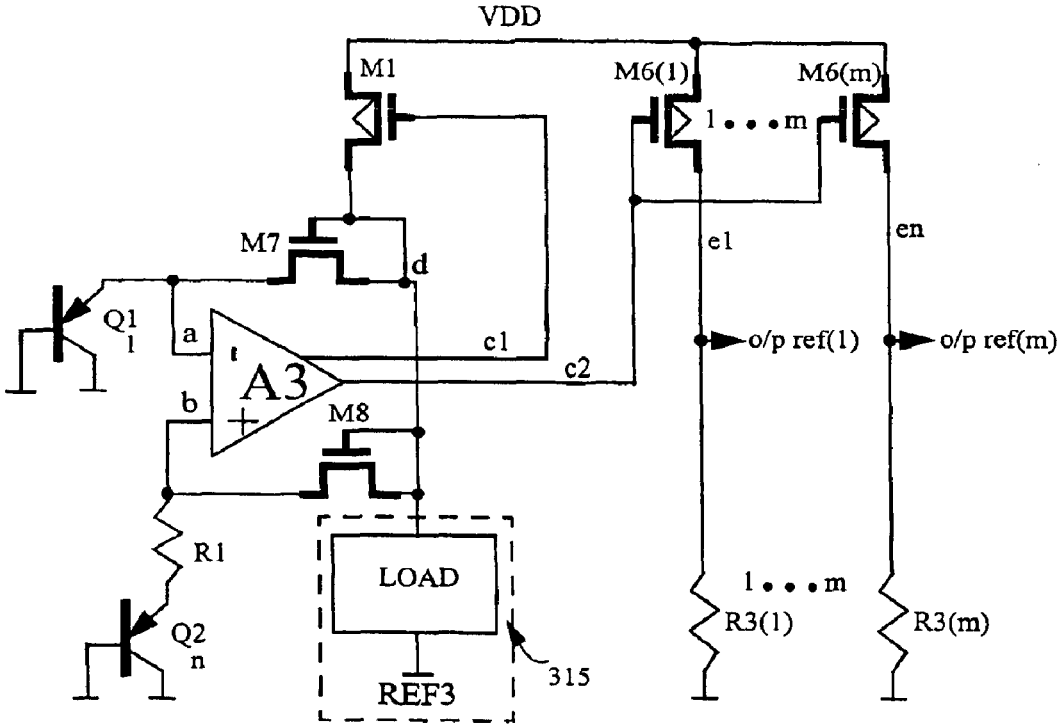
FIG. 7 is a schematic diagram of a reference current and reference voltage generating circuit according to a fourth embodiment of the present invention.

FIG. 7 is an extension of the architecture as shown in FIG. 3. It can be seen that the operational-amplifier A1 of FIG. 3 has been replaced by a modified version, operational-amplifier A3, which includes an additional, replica output terminal, so that A3 has two output terminals, namely out1 and out2. The addition of a second output terminal enables the driving of another current mirror. This approach has the advantage of allowing the separation of the control feedback circuit from the output current mirror design, which can be advantageous for the design of the amplifier and control response. Such an implementation ensures that an increase in the output capacitance which results when the number of MOSFETS used in the current generating circuit is increased, will not affect the operation of the feedback loop which is used to control the signal applied to the input nodes.

It will be appreciated by those skilled in the art that modifications may be made to the exact implementations of the present invention as shown in the preceding Figures, without departing from the scope of the invention. Examples of such modifications would include the incorporation of circuitry so as to provide for improvements in AC performance and implementations in accordance with linear design techniques as will be apparent to those skilled in the art.

It will be further appreciated by those skilled in the art that the current mirrors, in each of the Figures may also be replicated (as was the case of the resistive components) by using a digitally programmable DAC function programmed to give a current mirror configuration, instead of hardcoding the components. Similarly, the feedback elements and any of the active devices of the previous figures could also be implemented alternatively using suitable programmable components. The advantages of such an implementation include the feature that adjustment of the output current value and temperature coefficient may be allowed.

It will be appreciated that the present invention provides a reference source which has several advantages over the prior art. As will be apparent from the description of the exemplary embodiments of the invention, circuitry of the present invention requires the use of only one control amplifier. The amplifier is provided with dual feedback loops which are coupled to the first and second input nodes of the amplifier. The input nodes of the amplifier are additionally coupled to ground via active components such as transistors, and any passive components, such as impedance components in the form of resistors are provided in series with the active components in the input paths of the amplifier. This reduction in the number of components required to provide the bandgap reference source is very advantageous in designs where cost and supply current are critical. In preferred embodiments, a combination of PTAT and CTAT currents are provided, typically by the incorporation of impedance elements in the form of resistors in either the input or feedback paths of the amplifier. Additional loading of the feedback terminal d can also be used to modulate the temperature dependence of the current.

The circuit of the present invention also enables the follower devices to be sized so as to achieve improved temperature performance and process insensitivity. It will, for example, be appreciated that if M7, M8 and M9 have the same aspect ratio, the voltage curvature of the reference voltage is as occurs naturally, being typically 2.5 mV–5 mV for a reference voltage of 1.25V. In a balanced embodiment however, if M9 has a smaller aspect ratio compared to M7 and M8, then the drain-source voltage of M9 will be higher than that of M7 and M8.

There are many resulting advantages from such an embodiment including resistor R2 will be lower in value, the gate-source voltage (Vgs) will also increase which will in turn reduce the circuit mismatch sensitivity, and the body effect of M9 can be used to correct the reference voltage/current curvature.

Further to these advantages, the combined feedback paths in the configurations of the present invention have a single current mirror structure, or device. This is advantageous in that combining both CTAT and PTAT current feedback maximises the robustness of the current mirror design, especially in low power consumption designs.

It is possible to provide a modification to the current control block described before so as to provide for a controllable current output as the output of the control block. FIG. 8 shows such an example of such a control block and similarly to that described above the current control block of FIG. 8 may be coupled to nodes c, d and e of FIG. 3. The circuitry of FIG. 8 requires a current input, but it will be appreciated that this input does not have to be provided by circuitry such as that described in the previous Figures, as any input (voltage or current) could provide a suitable signal to the input node c.

Desirably, a current input is provided at c, and is coupled to the gate of M1. R6 and R7 are coupled to VDD and also to the sources of MOSFETs M1 and M6 respectively. A resistor R5 is also connected between VDD and the drain of MOSFET M10. The gate of M1 is coupled to the gate of M6 and the gate of a MOSFET M6*b*(1).

The source of MOSFET M6*b*(1) is coupled to VDD via a MOSFET M11, while its drain is coupled to node e. The drain of M1 is coupled to node d. The output of the amplifier A1 of FIG. 3 (node c) is also coupled to the gate of M1. The drain of M6 is coupled via resistor R3 to ground.

In this circuitry the non-inverting terminal of an amplifier A4 is also coupled to the drain of M6. The output of A4 is coupled to the gate of MOSFET M10, the source of which is coupled back to the inverting terminal of the amplifier. A resistor R4 couples the source of M10 to ground.

A control voltage Vgc is coupled to the drain of M10 and the gate of the MOSFET M11. The control voltage Vgc is converted by M11 to a current which is then coupled to the source of M6(*b*). It will be appreciated that the functionality of the MOSFET M11 is that of controllable impedance and may be provided by any type or combination of impedance devices such as passive and/or active devices. As such the current provided at the source of M6(*b*) is a controllable current, whose values are determined by the choice of impedance elements provided by the functionality of M11 and their effect on the control voltage Vgc. When PMOS MOSFET M1 is on, outputs are provided at nodes d and C. This current in M1 will then be replicated in R7 and M6. The resulting voltage across R3 creates a voltage reference for the A4, M10, R4 voltage to current conversion circuit. If R4 is equal to R5, this voltage drop across R4 will also be the reflected as the voltage across R5. Desirably, the resistors are all formed in the same manufacturing process and will therefore compensate for large scale process variations.

Therefore, it will be appreciated that difference in impedance of the devices M1 and R6 with respect to M11 and M6(*b*) causes the current through e to differ from that through d. This difference is controlled by the effect of Vgc acting on M11, and as such it will be understood therefore that the circuitry illustrated in FIG. 8 provides for a control voltage which may be used in combination with controllable impedances to provide a controllable current output as the output of the current mirror.

Figure 8:
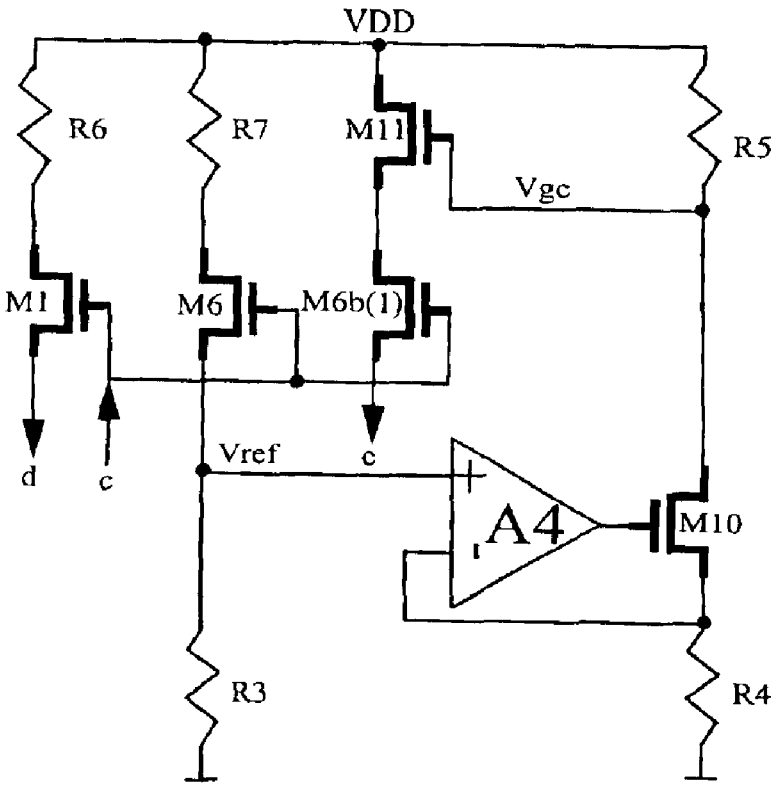
FIG. 8 is a schematic diagram showing a modification to the current control block providing a controllable output.

It will be understood therefore that the circuitry of FIG. 8 includes a reference circuit having a first and second leg. The first leg is formed by a first transistor M1 in series with a reference impedance R6, the second leg being formed by a second transistor M6(*b*) in series with a controllable impedance M11. The reference circuit includes a first (node c) and second (Vgc)inputs. It will be appreciated that in the implementation of FIG. 8 that the second input is derived from the signal provided at node "c" by additional circuitry of FIG. 8. The first input is coupled to the tied gates of the first and second transistors and the second input is coupled to the controllable impedance thereby providing a controllable impedance at the source of the second transistor. The output of the reference circuit, node "e" is dependent on the relative sizing of the controllable impedance and reference impedances and the first transistor and second transistors.

Figure 9:
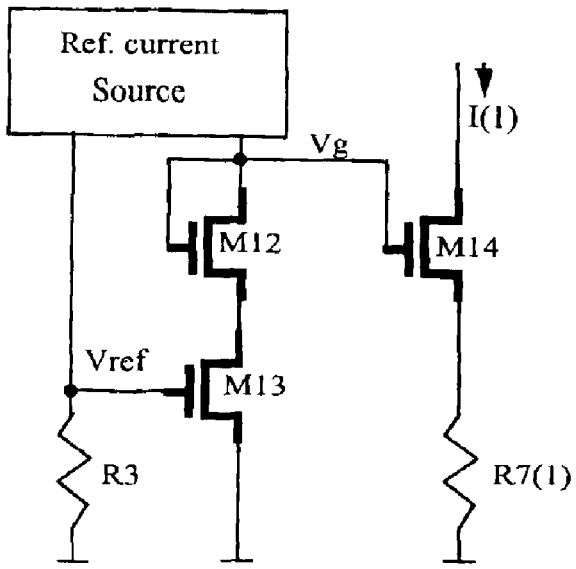
FIG. 9 is a schematic of an current control block according to a further embodiment of the present invention.

FIG. 9 shows a modification to the circuitry of FIG. 8 for implementation in a current sink as opposed to current source operation. In FIG. 9 a reference current source provides two inputs, Vg and Vref. Vref, it will be appreciated is a voltage formed by the application of an applied current input across resistor R3. A first leg of the reference circuit is formed by the transistor M14 in series with the resistor element R7(1), and the second leg is formed by the transistor M12 in series with the controllable impedance provided by the MOSFET M13. Similarly to that described above the first input, Vg, is coupled to the tied gates of the first and second transistors and the second input, Vref, is coupled to the controllable impedance thereby providing a controllable impedance at the source of the second transistor. The output of the reference circuit, I(1) is dependent on the relative sizing of the controllable impedance and reference impedances and the first transistor and second transistors.

Figure 10:
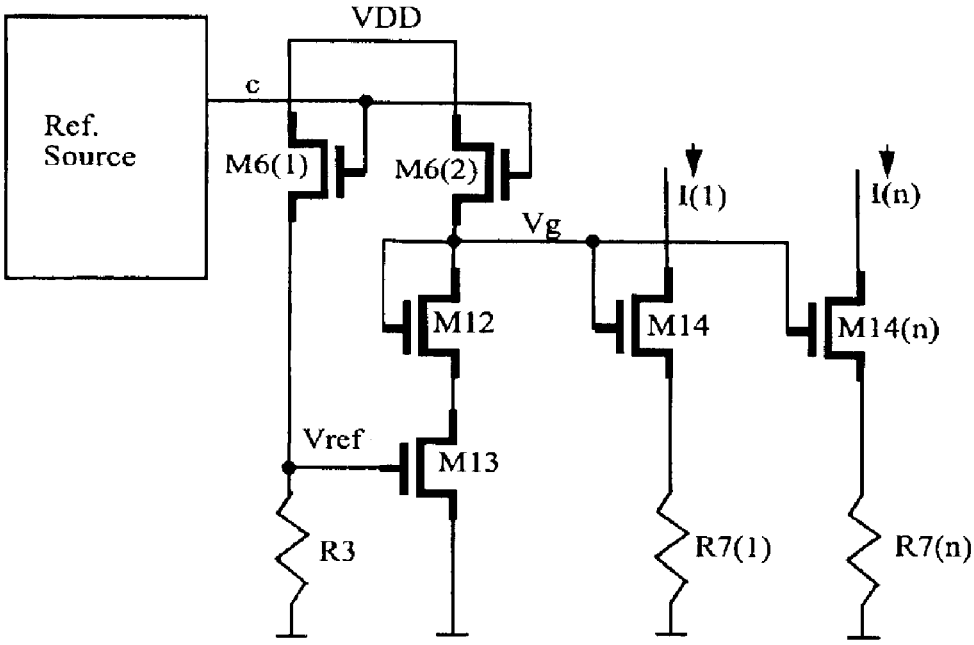
FIG. 10 is a detailed schematic of FIG. 9, showing additional components which may be used so as to compensate for beta variance.

FIG. 10 shows incorporation of additional components into the reference circuit illustrated in FIG. 9 so as to provide for beta cancellation. In the embodiment of FIG. 10, a NMOS current sink control circuit with MOS beta cancellation could be generated using an NMOS mirror. The sources of PMOS MOSFETS M6(1) and M6(2) are connected to Vdd. The gates of M6(1) and M6(2) are connected to node c of FIG. 3, which will be understood as providing the first input to the circuit. The drain of M6(1) is coupled to ground via a resistor R3. The drain of M6(2) is coupled to the drain of a MOSFET M12, which in turn is coupled to a MOSFET M13. M13 provides a controllable impedance which is coupled to Vref, which provides the second input to the circuit. The gate of M12 is also coupled to the gates of n other MOSFETs, illustrated in FIG. 10 as M14 and M14(*n*). These MOSFETs act as current sinks, and are coupled to ground via resistors R7 and R7(*n*). In operation the current flowing through M6(2) flows through M12 and M13. The causes M14 and M14(*n*) to act as current sinks with MOS beta cancellation.

It will be appreciated that was has been described herein is an improved bandgap reference source that uses a single amplifier with dual feedback loop to provide the necessary combination of PTAT and CTAT currents which are required for a bandgap reference source. By modification of the circuitry the source can be adapted for use as a reference current or voltage source. The invention has also provided a reference circuit that can be used to provide a controllable output, which may provide for beta cancellation in certain embodiments.

The words "comprises/comprising" and the words "having/including" when used herein with reference to the present invention are used to specify the presence of stated features, integers, steps or components but does not preclude the presence or addition of one or more other features, integers, steps, components or groups thereof.

There has been described herein a reference circuit and control block that offer distinct advantages when compared with the prior art. It will be apparent to those skilled in the art that modifications may be made without departing from the spirit and scope of the invention. Accordingly, it is not intended that the invention be limited except as may be necessary in view of the appended claims.

What is claimed is:

1. A bandgap reference circuit providing a reference node at an output, the circuit comprising an amplifier having first and second inputs and an output, the output being coupled to an input of a current control block, the current control block having first and second outputs, a first output being coupled to the output reference node and the second output being coupled to a dual feedback loop of the amplifier, thereby coupling the output of the amplifier to the first and second inputs of the amplifier, each of the first ad second inputs being additionally coupled to a respective first and second reference node, one of the inputs being coupled directly to its respective reference node via an active device and the second input node being coupled to its respective reference node via an impedance element in series with a second active device, said active devices being bipolar transistors and the dual feedback loop being provided with second active elements; at least one feedback path of the dual feedback loop being coupled via a third reference node to a load configured to provide a CTAT current.

2. The circuit as claimed in claim 1 wherein the first and second reference nodes are at the same potential.

3. The circuit as claimed in claim 2 wherein the potential is a ground potential.

4. The circuit as claimed in claim 1 wherein the impedance element is implemented using a programmable device.

5. The circuit as claimed in claim 1 wherein the output reference node is provided between the output of the current control block and an impedance component provided between the output of the current control block and a reference node, thereby providing a voltage reference source.

6. The circuit as claimed in claim 1 wherein the input to the current control block is provided as a voltage signal.

7. The circuit as claimed in claim 1 wherein the input to the current control block is provided as a current signal.

8. The circuit as claimed in claim 1 wherein the amplifier further comprises a second output node, the first output node being coupled via a first current mirror to the feedback loop of the amplifier and the second output node being coupled via a second current mirror to the output reference node, the first current mirror and the second current mirror being within the current control block.

9. The circuit as claimed in claim 1 wherein the load includes a transistor component provided in a tranistor follower configuration, the source of the transistor being coupled via an impedance element to ground.

10. A bandgap reference circuit providing a reference node at an output, the circuit comprising an amplifier having first and second inputs and an output, the output being coupled to an input of a current control block, the current control block having first and second outputs, a first output being coupled to the output reference node and the second output being coupled to a dual feedback loop of the amplifier, thereby coupling the output of the amplifier to the first and second inputs of the amplifier, each of the first and second inputs being additionally coupled to a respective first and second reference node, one of the inputs being coupled directly to its respective reference node via an active device and the second input node being coupled to its respective reference node via an impedance element in series with a second active device, said active devices being bipolar transistors and the dual feedback loop being provided with second active elements; at least one feedback path of the dual feedback loop being coupled via a third reference node to a load configured to provide a PTAT current, the PTAT current being output referred.

11. The circuit as claimed in claim 10 wherein the load includes a diode component in series with an impedance element, one or other of the diode or impedance element being coupled to ground.

12. The circuit as claimed in claim 1 wherein the current control block includes a current mirror having a first, second and third transistor, the sources of each transistor being coupled to a supply potential, the gates of the first, second and third transistor being coupled to one another and the second transistor being provided in a transistor follower configuration, the output of the amplifier being provided to the coupled gates of the first, second and third transistors, the drain of the first transistor providing the second output of the current mirror and the drain of the third transistor providing the first output of the mirror.

13. The circuit as claimed in claim 1 wherein the current control block includes a current mirror having a first and second transistor, the sources of each transistor being coupled to a supply potential, the drain of the first transistor providing the first output of the mirror, the drain of the second transistor providing the second output and the gates of the two transistors being coupled to one another, with the output of the amplifier being coupled to the gates of the first and the second transistors.

14. The circuit as claimed in claim 1 wherein the current control block includes circuitry adapted to provide for a correction of beta variance.

15. The circuit as claimed in claim 14 wherein the circuitry is adapted to provide for a correction of beta variance provides a current bias that varies inversely with beta variance, the inverse current bias being provided in a feedback loop within a current mirror provided within the current control block, thereby substantially correcting varlance.

16. The circuit as claimed in claim 1 wherein the current control block provides for a control voltage which in combination with a controllable impedance provides for the current provided at the output reference node to be controllable.

17. The circuit as claimed in claim 16 wherein the control voltage provided is substantially independent of process variation within the circuit.

18. A bandgap reference circuit providing a reference node at an output, the circuit comprising an amplifier having first and second inputs and an output, the output being coupled to an input of a current mirror, the current mirror having first and second outputs, a first output being coupled to the output reference node and the second output being coupled to a dual feedback loop of the amplifier, thereby coupling the output of the amplifier to the first and second inputs of the amplifier, the first and second inputs being additionally coupled to a first and second reference node, one of the input nodes being coupled directly to its respective reference node via a transistor and the second input node being coupled via an impedance element in series with a second transistor, and wherein the circuit additionally includes a load coupled at a selected node to at least one of the feedback paths, the load being coupled also to a third reference node and configured to provide a CTAT current to the selected node.

* * * * *